United States Patent [19]

Warneke

[11] 3,996,679

[45] Dec. 14, 1976

[54] BADGE

[76] Inventor: Richard J. Warneke, 915 West Miner, Arlington Heights, Ill. 60006

[22] Filed: Mar. 17, 1975

[21] Appl. No.: 559,326

[52] U.S. Cl. ..... 40/1.5

[51] Int. Cl.[2] ..... A44C 3/00

[58] Field of Search ..... 40/1.5, 20 R, 23 R, 40/315; 63/20

[56] References Cited

UNITED STATES PATENTS

| | | | |
|---|---|---|---|
| 924,946 | 6/1909 | Taylor | 40/23 R X |
| 1,426,853 | 8/1922 | Geist | 40/20 R |
| 1,429,465 | 9/1922 | Tolg | 40/20 R |
| 1,852,255 | 4/1932 | Miller | 40/20 R |
| 2,138,361 | 11/1938 | Snelling | 40/23 R |
| 2,609,629 | 9/1952 | Hubbard | 40/1.5 |

*Primary Examiner*—Louis G. Mancene
*Assistant Examiner*—John H. Wolff
*Attorney, Agent, or Firm*—Wallenstein, Spangenberg, Hattis & Strampel

[57] ABSTRACT

A badge for temporary attachment to an article of clothing such as a shirt, a blouse, or the like. Attachment is achieved with fabric engaging means formed in the badge which eliminates the need for auxiliary fastening means such as a pin, or a pressure sensitive adhesive coating commonly used on conventional badges to enable them to be attached to clothing.

1 Claim, 14 Drawing Figures

BADGE

The present invention relates to a device, or badge, adapted for temporary attachment to an article of clothing such as a shirt, a blouse, or the like.

Badges adapted to be temporarily worn on an article of clothing, and which carry indicia on the face thereof either for identification or other informational purposes, have long been in use. Generally speaking, such badges utilize auxiliary fastening means such as a pin, or a pressure sensitive adhesive coating, to maintain the badge in position on an article of clothing.

Badges of this type have a number of disadvantages, chief among which is their comparatively high cost of manufacture. More specifically in this connection, badges employing a pressure sensitive adhesive coating require not only that a special adhesive be applied to at least the greater portion of the back of the badge, but, also, require the use of a release coated backing sheet to protect the adhesive coating until the badge is ready to be worn. In the case of badges employing fastening means such as pins, the pin constitutes a separate element of the badge and requires special equipment to secure it on the badge. Over and above this consideration, badges which utilize a pin to attach them to an article of clothing require the user to force the point of the pin through the article of clothing. Not infrequently, the user of such a badge will jab the point of the pin into his or her finger. Such badges, clearly, are unsafe, and this is especially so where the intended user is a child.

In accordance with the present invention, a device, or badge, is provided which eliminates the aforementioned disadvantages of conventional badges. The badge of this invention not only does not require a pin, or a pressure sensitive adhesive to attach it to an article of clothing, but, also, can be manufactured at minimal cost from a unitary piece of inexpensive, readily-available material in a single forming operation. Furthermore, the badge of this invention is completely safe, and can be used with equal facility by adults as well as children.

Briefly, the device, or badge, of the present invention comprises a body portion and a rearwardly extending support portion. The body portion may have a conventional four-sided configuration, or, especially in those instances where the device is intended for use by children, it may be in the shape of an airplane, animal, flower, or other fanciful configuration, as desired. The front, or forward, face of the body portion is adapted to carry printing, art work, symbols, or other indicia. The support portion is provided with fabric engaging means which comprises opposed, slightly spaced fabric engaging surfaces or points, and includes fabric receiving means for retaining a portion of the fabric inwardly of the fabric engaging surfaces or points. The body portion and the support portion advantageously comprise a unitary, integrated structure, with the fabric engaging means being formed directly in the support portion.

The foregoing, and other advantages and features of the invention will become apparent in the light of the description to follow, taken in conjunction with the accompanying drawings wherein.

Figure 1:
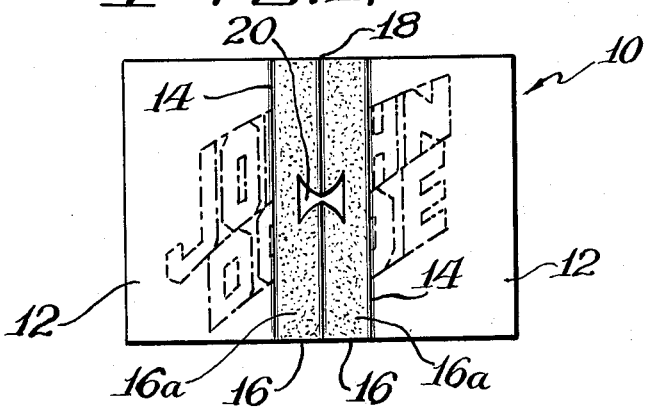
FIG. 1 is a top plan view of a blank from which an embodiment of the badge of this invention can be formed.

Referring now in greater detail to FIG. 1 of the drawings, a blank 10 of an embodiment of the device of the invention is illustrated. As shown, the blank 10 includes a pair of outer panels 12—12 which comprise the indicia-bearing, or body portion, of the device. Joined to the panels 12—12 along score or fold lines 14—14 are a pair of narrow, inner panels 16—16. The panels 16—16 comprise the support portion of the device and are joined along a central score or fold line 18. The blank 10 advantageously is fabricated from a single piece of a resilient, flexible material such as cardboard, paperboard, chipboard, plastic, or even a lightweight metal such as aluminum.

Figure 2:
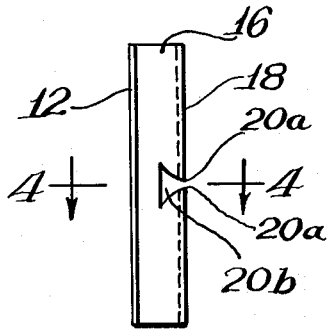
FIG. 2 is a side view in elevation of said embodiment of the invention formed from the blank shown in FIG. 1.

As illustrated, the panels 16—16 are provided with an hour glass, or wing-shaped opening 20, the apexes of which are joined at their point of intersection with the score or fold line 18. When the panels 16—16 are folded rearwardly along score or fold lines 14—14, and the front faces **16*a*—16*a* of the panels 16—16 are folded into opposed relation along score or fold line 18, as shown in FIG. 2, the configuration of the opening 20 results in the provision of slightly spaced, opposed fabric engaging surfaces, or points 20*a*—20*a*, and a fabric receiving recess or compartment 20*b*, in the rearwardly extending support portion of the device formed by the panels 16—16. In those instances where the blank 10 is fabricated of a material such as cardboard, paperboard, and the like, the opposed front faces 16*a*—16*a* of the panels 16—16** advantageously are adhered together as by gluing. Any conventional adhesive or glue may be used for this purpose.

Figure 3:
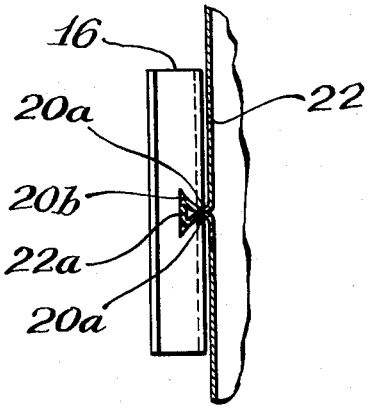
FIG. 3 is a side view, partly in section, showing the badge attached to an article of clothing.
Figure 4:
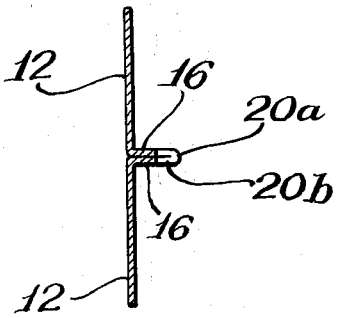
FIG. 4 is a sectional view taken substantially along line 4—4 of FIG. 2.

In use, as shown in FIG. 3, a small portion of the fabric 22 of a shirt, or blouse, for example, is folded and then guided through the narrow slit or space between the fabric engaging points **20*a*—20*a*. The flexible nature of the material of which the device is fabricated enables this operation to be achieved with minimum force, and the fabric is not in any way damaged. As the fold 22*a* in the fabric 22 moves past the points 20*a*—20*a*, the natural resiliency of the fabric 22 tends to cause it to expand in the recess or compartment 20*b* in the support portion of the device. The expansion of the fold 22*a*, coupled with the holding action of the opposed fabric engaging points 20***a*—20*a*, act to snugly maintain the device on an article of clothing to which it is attached. The device can be disengaged from the fabric by pulling it outwardly and away from the fabric, again, without causing any damage to the fabric.

Referring, now, to FIGS. 8 through 14 of the drawings, the blank 10′, like the blank 10 of FIG. 1, comprises a pair of outer panels 12′—12′ joined along score or fold lines 14′—14′ to a pair of narrow, inner panels 16′—16′. The panels 16′—16′ are joined along a central score or fold line 18′. The score or fold lines 14′—14′ and 18′ may be perforated to facilitate forming of the blank 10′ into a badge. The materials noted above for use in the fabrication of the blank 10 can also be used to make the blank 10′.

The panels 16′-16- of the blank 10′ differ from the panels 16—16 of the blank 10 in that only one of the panels is die-cut to provide an opening 20′ therethrough. The other panel is provided with a pair of perforated, covergent score lines 24—24. The lines 24—24 intersect with the score line 14′ of the panel 16′ in which they are formed, and, together with a segment 14*a′* defined by the points at which they intersect with their associated score line 14′, provide a hinged locking tab 26, the function of which will become clear as the description proceeds.

Figure 9:
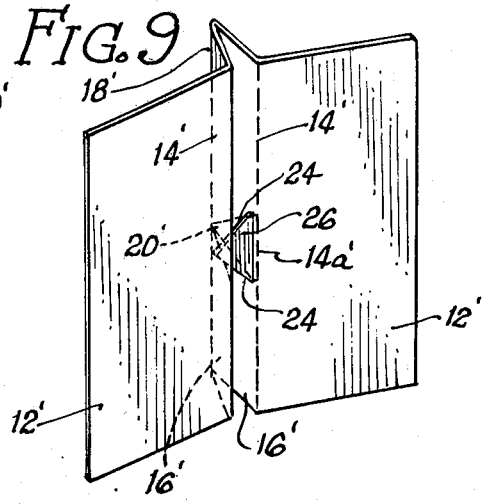
FIG. 9 is a view in perspective showing the blank of FIG. 1 at one stage in the formation of said embodiment.
Figure 10:
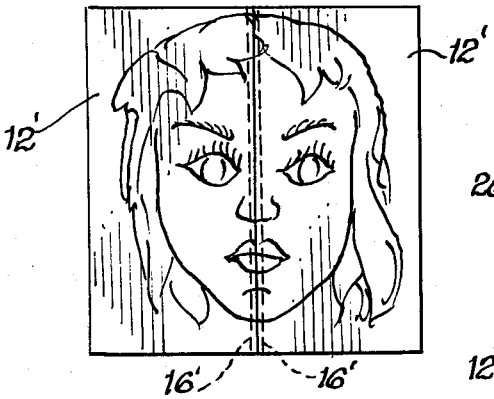
FIG. 10 is a front view of said embodiment as formed from the blank illustrated in FIG. 8.
Figure 11:
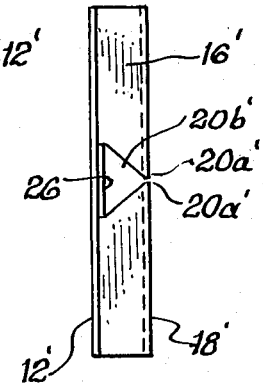
FIG. 11 is a side view of the embodiment shown in FIG. 10.
Figure 12:
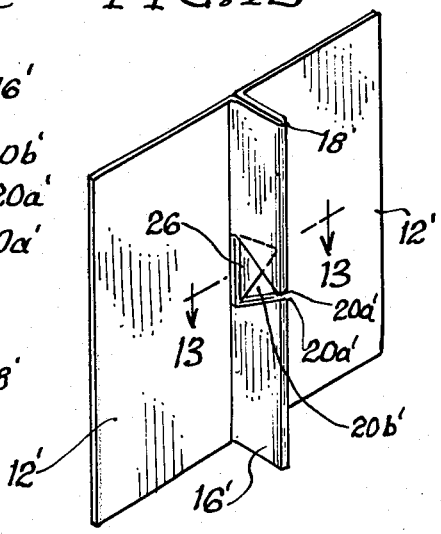
FIG. 12 is a view in perspective of the back of the embodiment shown in FIG. 10.
Figure 13:
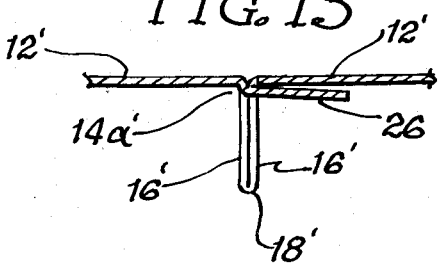
FIG. 13 is a sectional view taken substantially along line 13—13 of FIG. 12.

As shown in FIGS. 9 through 13 of the drawings, a badge is formed from the blank 10′ by folding the panels 16′—16′ rearwardly along score or fold lines 14′—14′. The locking tab 26 is separated from its associated inner panel 16′ along perforated score lines 24—24, but remains hinged to its associated outer panel 12′ along the segment 14*a′* of the adjacent score or fold line 14′. As best illustrated in FIGS. 9, 12 and 13, the hinged tab 26, which corresponds generally in shape to the opening 20′ in the other inner panel 16′, is passed through the opening 20′ until the front faces of the panels 16′—16′ are brought into opposed relation. The tab 26 is then folded along segment 14*a′* of its associated score line 14′ against the rear face of the panel 12′ to which it is not hinged. As a result, the inner panels 16′—16′ are locked together, and the need for glue, for example, to hold the opposed surfaces thereof in contact with one another is eliminated.

The separation of the tab 26 from its associated panel 16′ along perforated score lines 24—24 provides a pair of slightly spaced, opposed fabric engaging surfaces, or points, 20*a′*—20*a′* corresponding to the points 20*a*—20*a* which result when the blank 10 is formed into a badge. In addition, the opening resulting from the folding of the locking tab 26 into position through the opening 20′ forms, in cooperation with the opening 20′, a fabric receiving recess or compartment 20*b′* in the opposed panels 16′—16′ inwardly of the points 20*a′*—20*a′*.

Figure 14:
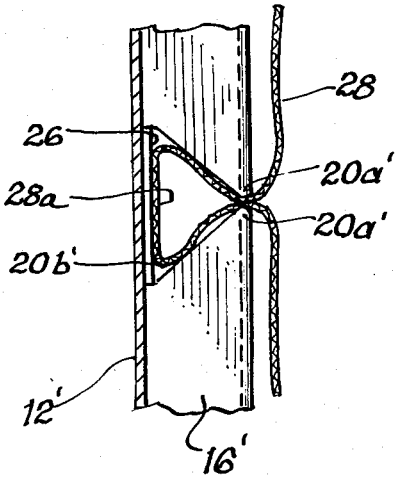
FIG. 14 is an enlarged side view, partly in section, showing the badge formed from the blank illustrated in FIG. 8 attached to an article of clothing.

The badge formed from the blank 10′ is attached to an article of clothing in the same manner as described above in relation to the badge formed from the blank 10. Thus, as shown in FIG. 14, a small portion of the fabric 28 of a shirt, or blouse, for example, is folded and then passed through the narrow slit or space between the opposed fabric engaging points 20*a′*—20*a′* in the support portion of the badge comprised of the panels 16′—16′. As the fold 28*a* in the fabric 28 moves past the points 20*a′*—20*a′* the natural resiliency of the fabric 28 tends to cause the fold 28*a* to expand in the recess or compartment 20*b′*. This expansion of the fold 28*a*, together with the holding action on the fabric 28 provided by the points 20*a′*—20*a′*, act to maintain the device on an article of clothing. The locking tab 26, of course, retains the panels 16′—16′ in locked contact with each other at all times.

The support portion of the badge may be provided with a second opening (not shown) therethrough to enable a child to attach two or more badges to a straw, for example, which can be passed through the second opening in each of the badges. Thus, a number of badges can be arranged on the straw as desired and can be worn as a unit on an article of clothing.

Figure 5:
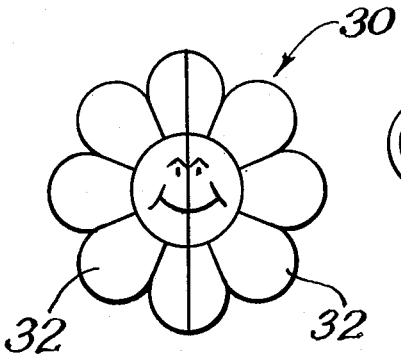
FIGS. 5–7 are modifications of said embodiment of the invention showing various shapes which the badge may have, said shapes being especially attractive to children.
Figure 6:
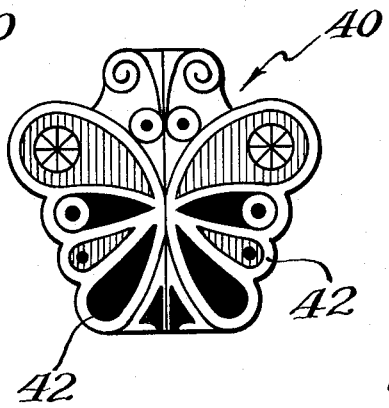
Figure 7:
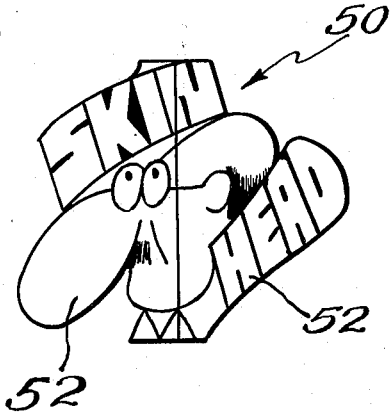
Figure 8:
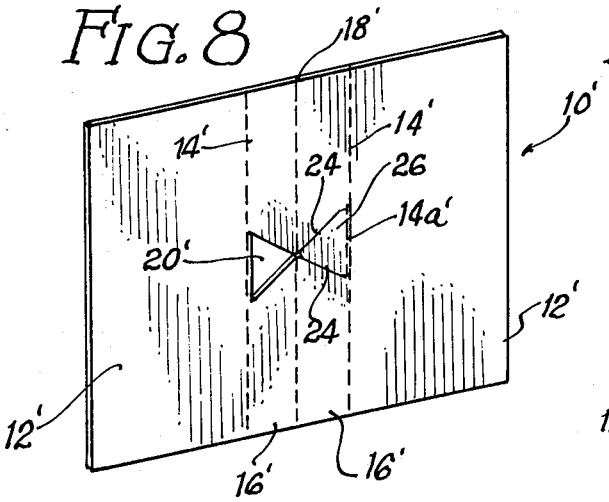
FIG. 8 is a view in perspective of a blank from which a preferred embodiment of the invention can be formed.

As indicated above, the outer panels 12—12 and 12′—12′, which comprise the body portion of the badge, can be shaped as desired. In FIGS. 5 through 7 there are illustrated exemplary embodiments of the badge in various shapes. Thus, in FIG. 5, the device 30, as shown, has panels 32—32 shaped and provided with art work which give the device 30 the appearance of a flower. In FIG. 6, device 40 has panels 42—42 shaped as wings and colored to give the device the appearance of a butterfly. In FIG. 7, the device 50 has panels 52—52 shaped and provided with copy to give the device the appearance of a caricature.

While for purposes of illustration the device has been shown and described in relation to particular embodiments, other forms of the device may become apparent to those skilled in the art upon reading this disclosure, and, therefore, it should be understood that any such departures from the particular embodiments shown and described are intended to fall within the spirit and scope of the invention.

What is claimed is:

1. A device for temporary attachment to an article of clothing, comprising a body portion formed of a pair of panels adapted to carry indicia on the outer surface thereof, a rectangular support portion formed of a pair of opposed panels, the panels of the support portion being joined to one another along one of their major margins and each of these support panels being joined to a different one of the panels of the body portion along another of their major margins, one of the support panels having tab means adapted to maintain the panels of the support portion in superposed relation, and fabric engaging means provided in the panels of the support portion and extending inwardly from said one of their margins, the fabric engaging means providing opposed, slightly spaced and diverging fabric engaging surfaces for receiving a fold of fabric therebetween, said tab means in cooperation with the fold of fabric serving to maintain said support panels in superposed relation whereby the device is displayed on an article of clothing to which it is temporarily attached.

* * * * *